US009540988B2

(12) United States Patent
Yamashiro et al.

(10) Patent No.: US 9,540,988 B2
(45) Date of Patent: Jan. 10, 2017

(54) COVER STRUCTURE OF INTERNAL COMBUSTION ENGINE FOR MOTORCYCLE

(71) Applicant: HONDA MOTOR CO., LTD., Tokyo (JP)

(72) Inventors: Hayato Yamashiro, Wako (JP); Kazuma Tanaka, Wako (JP); Takashi Toriki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 139 days.

(21) Appl. No.: 14/304,402

(22) Filed: Jun. 13, 2014

(65) Prior Publication Data

US 2015/0000616 A1 Jan. 1, 2015

(30) Foreign Application Priority Data

Jun. 26, 2013 (JP) ..... 2013-134060

(51) Int. Cl.

| | |
|---|---|
| ***F01P 7/14*** | (2006.01) |
| ***F02B 77/04*** | (2006.01) |
| ***F01P 11/04*** | (2006.01) |
| *F02B 61/02* | (2006.01) |
| *F02F 7/00* | (2006.01) |
| *F01P 7/16* | (2006.01) |

(52) U.S. Cl.

CPC *F01P 11/04* (2013.01); *F01P 7/16* (2013.01); *F01P 7/167* (2013.01); *F01P 2007/146* (2013.01); *F01P 2025/62* (2013.01); *F01P 2050/16* (2013.01); *F01P 2060/08* (2013.01); *F02B 61/02* (2013.01); *F02F 7/007* (2013.01)

(58) Field of Classification Search

CPC ..... F01P 7/16; F01P 7/167; F01P 2007/146; F01P 2060/08; F01P 2025/62

USPC ..... 123/41.1

See application file for complete search history.

(56) References Cited

U.S. PATENT DOCUMENTS

2008/0047503 A1* 2/2008 Negoro ..... F01P 11/04 123/41.7

FOREIGN PATENT DOCUMENTS

JP 2008-051077 3/2008

* cited by examiner

*Primary Examiner* — Lindsay Low
*Assistant Examiner* — Charles Brauch
(74) *Attorney, Agent, or Firm* — Rankin, Hill & Clark LLP

(57) ABSTRACT

A cover structure of an internal combustion engine of a motorcycle includes an engine that is mounted on a motorcycle and includes a cooling device for cooling the engine. The cover structure includes a sprocket cover portion that covers from the width direction of the vehicle. The cover structure also includes a pipe cover portion that covers from the width direction of vehicle a discharge side hose and an intake side hose of the cooling device. The cover structure further includes a side surface cover that includes a joining portion which is vertically arranged from the sprocket cover portion towards the pipe cover portion so as to be in parallel with the discharge side hose. The intake side hose is arranged side by side in the width direction of the vehicle and integrally joins the sprocket cover portion with the pipe cover portion.

19 Claims, 14 Drawing Sheets

COVER STRUCTURE OF INTERNAL COMBUSTION ENGINE FOR MOTORCYCLE

BACKGROUND OF THE INVENTION

Field of the Invention

The present invention relates to a cover structure of an internal combustion engine for a motorcycle.

Description of Related Art

Conventionally, there has been known a cover structure in which cooling water pipes of an internal combustion engine are covered with a pipe cover provided integrally with a sprocket cover (for example, see Japanese Laid-open Patent Publication No. 2008-51077). In Japanese Laid-open Patent Publication No. 2008-51077, two cooling water pipes are aligned in the front-and-rear direction.

BRIEF SUMMARY OF THE INVENTION

Cooling water pipes of an internal combustion engine are often provided in plural. When two cooling water pipes are aligned in the front-and-rear direction as the above-mentioned conventional art, the pipe cover is provided over the front and rear cooling water pipes. As a result, the pipe cover which is swollen in the width direction of the vehicle becomes long in the front-and-rear direction. In particular, in an internal combustion engine mounted on a motorcycle, it is necessary to secure a space for the rider to put his/her foot on in the periphery of a cover structure provided on the internal combustion engine. Therefore, it is desirable to reduce the size in the width direction of the vehicle of the internal combustion engine including the cover structure.

The present invention has been achieved in consideration of the above-described circumstances. Accordingly, it is an object of the present invention to reduce the size in the width direction of the vehicle of an internal combustion engine including a cover structure covering a pipe.

To solve the above-mentioned problem, the present invention includes a cover structure of an internal combustion engine for a motorcycle having: an internal combustion engine, which is mounted on a motorcycle and includes a cooling device for cooling the engine, a cover, which is provided on the internal combustion engine so as to cover from the width direction of the vehicle a driving member provided on an output portion of the internal combustion engine for transmitting a driving force to a driving wheel, and a pipe cover portion, which is provided so as to cover from the width direction of vehicle a plurality of cooling water pipes of the cooling device, a side surface cover includes a joining portion which is vertically arranged from the cover towards the pipe cover portion so as to be in parallel with a plurality of the cooling water pipes arranged side by side in the width direction of the vehicle and integrally joins the cover with the pipe cover portion.

According to the present invention, it is possible to shorten the length in the front-and-rear direction of the pipe cover portion, which is swollen in the width direction of the vehicle, and to reduce the size in the width direction of the vehicle of the internal combustion engine including the pipe cover portion. Further, the cover and the pipe cover portion are integrally joined with the joining portion, which thereby can secure the rigidity. Accordingly, it is possible to effectively hold the cooling water pipes with the pipe cover portion and the joining portion.

In addition, in the area in parallel with the cooling water pipes in the joining portion, a joining position of the joining portion with the cover is provided so as to be closer to the cooling water pipes than a center axis of the output portion.

According to the present invention, the joining position of the joining portion with the cover is provided so as to be closer to the cooling water pipes than the center axis of the output portion, which thereby can reduce the space in the front and in the rear of the pipe cover portion and the joining portion. Thus, it is possible to reduce the size in the width direction of the portion on the lateral side of the output portion in the internal combustion engine.

In addition, the motorcycle includes a change shaft, which is provided on the rear and upper portion of the internal combustion engine and inputs the shift operation of the internal combustion engine, a shift pedal, which is provided on the vehicle body for the rider to perform the shift operation, and a shift rod, which joins the change shaft and the shift pedal, and reinforcing swelling portions, which are joined to the upper end portion and the lower end portion of the joining portion and are gradually bulged from the cover towards the pipe cover portion, are provided further forward than the shift rod which passes by the side of the output portion of the internal combustion engine.

According to the present invention, by reinforcing the upper end portion and the lower end portion of the joining portion with the reinforcing swelling portions, the rigidity of the entire cover can be effectively enhanced.

Further, the present invention includes openings, which penetrate on the side provided with the cooling water pipes, are formed so as to be close to the joining position with the cover in the joining portion.

According to the present invention, since the cover can be attached while checking the position of the cooling water pipes through the openings which penetrate on the side provided with the cooling water pipes, the workability can be enhanced.

In addition, the present invention includes openings are provided in plural in the upper and lower portion, and a central reinforcing portion, which is gradually bulged from the cover towards the joining portion, is formed between the openings.

According to the present invention, even in the configuration provided with the openings, the rigidity can be secured with the central reinforcing portion.

Moreover, electric wires of the motorcycle are arranged so as to be in parallel with the cooling water pipe while being sandwiched between the cooling water pipe and the cover and/or the joining portion.

According to the present invention, the electric wires are allowed to pass through the space of the cooling water pipes, and also can be effectively held by being sandwiched between the cooling water pipe and the cover.

Further, in a side view of the internal combustion engine, the electric wires are disposed so as to overlap the back side of the cooling water pipe.

According to the present invention, the electric wires can be hidden with the cooling water pipe, which thereby can improve the external appearance.

In addition, an electric wire holding portion for positioning the electric wires is integrally formed with the cover, and the electric wire holding portion is disposed so as to overlap the back side of the cooling water pipe in a side view.

According to the present invention, the electric wires can be positioned with the integrally-formed electric wire holding portion, and the external appearance can be improved by hiding the electric wire holding portion with the cooling water pipe.

In the cover structure of the internal combustion engine according to the present invention, it is possible to shorten the length in the front-and-rear direction of the pipe cover portion, which is swollen in the width direction of the vehicle, and to reduce the size in the width direction of the vehicle of the internal combustion engine including the pipe cover portion. Further, the cover and the pipe cover portion are integrally joined with the joining portion, which thereby can secure the rigidity. Accordingly, it is possible to effectively hold the cooling water pipes with the pipe cover portion and the joining portion.

In addition, it is possible to reduce the size in the width direction of the portion on the lateral side of the output portion in the internal combustion engine.

In addition, by reinforcing the upper end portion and the lower end portion of the joining portion with the reinforcing swelling portions, the rigidity of the entire cover can be effectively enhanced.

Further, since the cover can be attached while checking the position of the cooling water pipes through the openings which penetrate on the side provided with the cooling water pipes, the workability can be enhanced.

In addition, even in the configuration provided with the openings, the rigidity can be secured with the central reinforcing portion.

Moreover, the electric wires are allowed to pass through the space of the cooling water pipes, and also can be effectively held by being sandwiched between the cooling water pipe and the cover.

Further, the electric wires can be hidden with the cooling water pipe, which can improve the external appearance.

Furthermore, the electric wires can be positioned with the integrally-formed electric wire holding portion, and the external appearance can be improved by hiding the electric wire holding portion with the cooling water pipe.

DETAILED DESCRIPTION OF THE INVENTION

Figure 1:
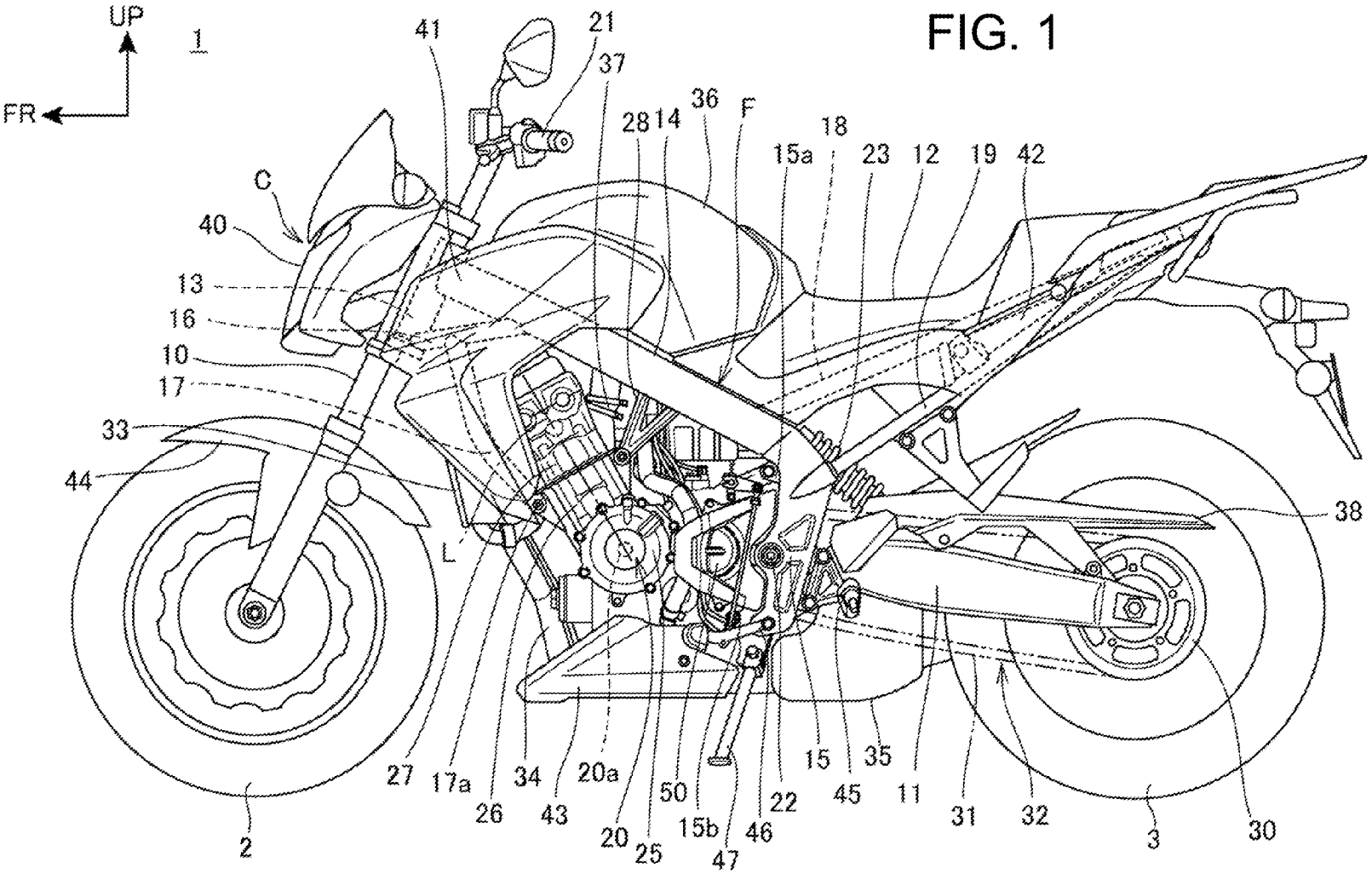
FIG. 1 is a left side elevation view of a motorcycle according to the embodiment of the present invention.

Hereinafter, the embodiment of the present invention will be described with reference to the drawings. Incidentally, the directions such as front and rear, left and right, upper and lower in the description below are the same as those of the vehicle body, unless it is explicitly stated otherwise. In the drawing, an arrow FR shows the front, an arrow UP shows the upper, and an arrow LE shows the left side of the vehicle body.

FIG. 1 is a left side view of a motorcycle according to the embodiment of the present invention.

A motorcycle 1 is a vehicle in which an engine 20 as a power unit is supported on a body frame F, a front fork 10 supporting a front wheel 2 is steerably supported on the front end of the body frame F, a swing arm 11 supporting a rear wheel 3 as a driving wheel is provided on the rear portion side of the body frame F. The motorcycle 1 is a straddle-type vehicle in which a seat 12 for a rider to sit on so as to straddle is provided on the upper of the central portion in the front and in the rear of the body frame F. The body frame F is partially covered with a resin-made body cover C.

The body frame F includes a head pipe 13, which is provided on the front end thereof, left and right pair of main frames 14, which extend rearward from the head pipe 13 so as to be inclined obliquely downward, and left and right pair of center frames 15 which extend downward from the rear end of each of the main frames 14. In addition, the body frame F includes left and right pair of reinforcing frames 16, which connect the lower portion of the head pipe 13 and the front portion of each of the main frames 14, and left and right pair of hanger frames 17 which extend downward from each of the reinforcing frames 16. Further, the body frame F includes left and right pair of seat frames 18, which extend upward to the rear direction from the rear end of each of the main frames 14, and left and right pair of subframes 19 which connect the upper portion of each of the center frames 15 and the rear end of each of the seat frames 18. Moreover, the body frame F includes a plurality of cross frames (not shown) which connect between the left and right frames in the width direction of the vehicle. Here, FIG. 1 shows only the left side of left and right pair of frames.

The front fork 10 is rotatably and pivotally supported through a steering shaft (not shown) on the head pipe 13, and the front wheel 2 is pivotally supported on the lower portion of the front fork 10. A handle 21 for steering is fixed on the upper end of the front fork 10.

The swing arm 11 is rotatably and pivotally supported by a pivot shaft 22, which is inserted between left and right center frames 15 in the width direction of the vehicle, and the rear wheel 3 is pivotally supported on the rear end of the swing arm 11. A rear suspension 23 spans between the swing arm 11 and the body frame F.

Figure 2:
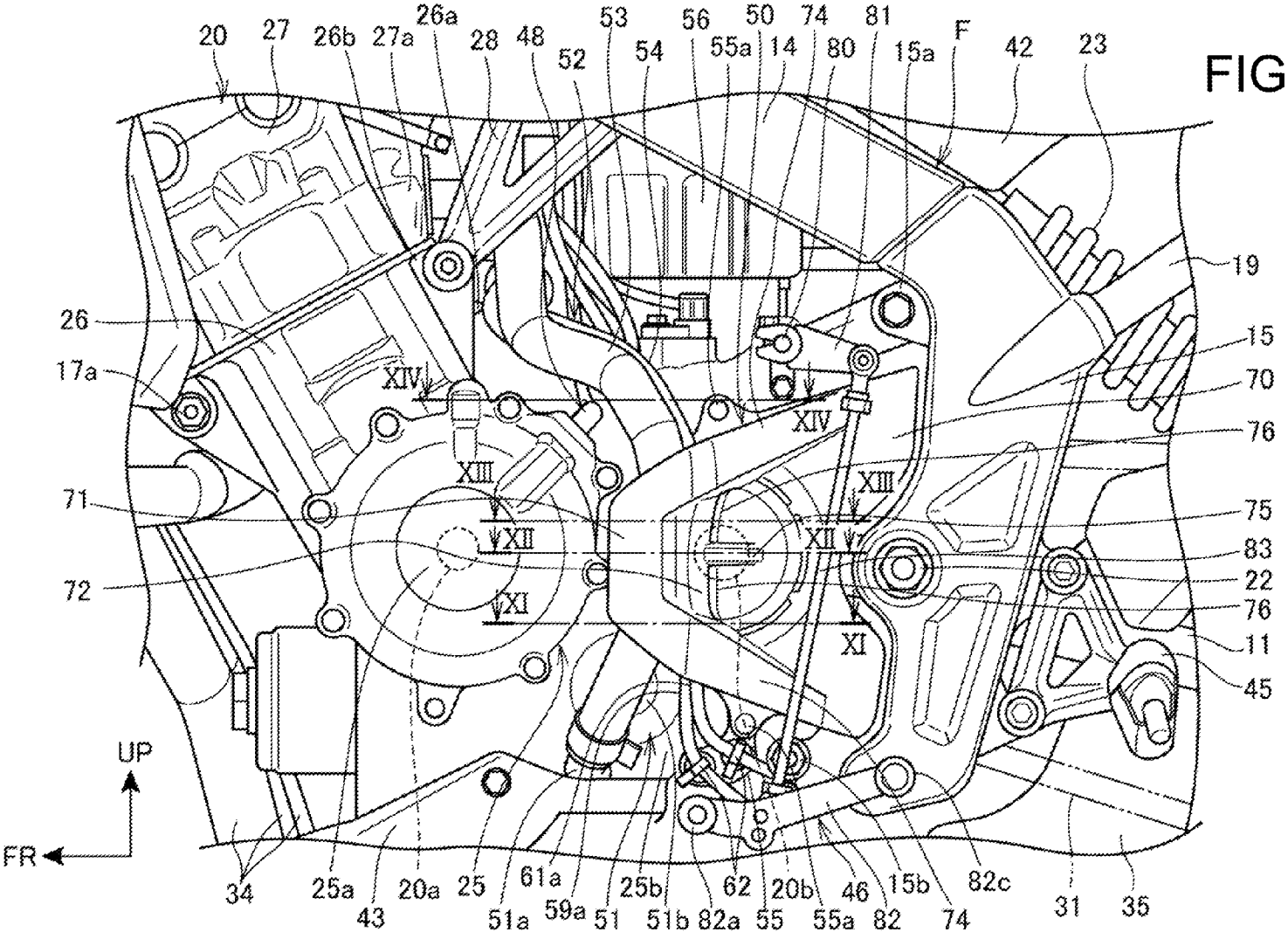
FIG. 2 is a left side elevation view of the periphery of a side surface cover.

FIG. 2 is a left side view of the periphery of the engine 20.

Referring to FIGS. 1 and 2, the engine 20 is a water-cooled, in-line 4-cylinder four-cycle engine, and a crankshaft 20*a* is disposed so as to extend horizontally in the width direction of the vehicle. The engine 20 has a crankcase 25, a cylinder 26, which is provided on the upper surface of the front portion of the crankcase 25, and a cylinder head 27, which is connected on the upper surface of the cylinder 26, and is provided such that a cylinder axis L is inclined forward.

The engine 20 is fixed to the body frame F via a lower end portion 17*a* of the hanger frame 17, an engine hanger 28, which is provided on the intermediate portion in the front and in the rear of the main frame 14, and fixing portions 15*a*, 15*b* which are provided on the upper portion and the lower portion of the center frame 15.

At the left side surface (one side surface) of the rear portion of the crankcase 25, an output shaft 20*b* (FIG. 2) of the transmission, which is incorporated in the crankcase 25, protrudes. The output shaft 20*b* extends in parallel with the crankshaft 20*a*. The output of the engine 20 is transmitted to the rear wheel 3 via a drive sprocket 29 (FIG. 3), which is provided on the output shaft 20*b* and functions as the driving member for transmitting the driving force, a driven sprocket 30, which is provided on the rear wheel 3, and a chain 31 which is wound round between the drive sprocket 29 and the driven sprocket 30. The drive sprocket 29, the driven sprocket 30 and the chain 31 constitute a driving force transmitting portion 32. The drive sprocket 29 is covered with a side surface cover 50. The upper portion of the chain 31 is covered from above with a chain cover 38 which is provided on the swing arm 11.

A plate-like radiator 33, in which the cooling water of the engine 20 circulates, is disposed in front of the cylinder 26 and the cylinder head 27.

Four exhaust pipes 34, which are joined respectively to each cylinder of the cylinder head 27 are drawn out downward from the front surface of the cylinder head 27, are collected to be one below the crankcase 25, and are joined to a muffler 35 which is provided below the center frame 15 on the right side.

A fuel tank 36 is provided above the main frame 14. The seat 12 is provided so as to be continuous to the rear portion of the main frame 14, and is supported on the seat frames 18.

An intake device 37, which includes the throttle body, and a fuel injection device (not shown), which supplies fuel to the intake passage, are disposed between the rear surface of the cylinder head 27 and the lower surface of the fuel tank 36.

The body cover C includes a front cover 40, which covers the head pipe 13 from the front, left and right pair of front side covers 41, which covers the front portion of the body frame F and the front portion of the fuel tank 36 from the side, and a rear cover 42 which covers the seat frames 18 from the side. In addition, the body cover C includes an undercover 43 which covers the front portion of the crankcase 25 from below. A front fender 44 is provided on the front fork 10.

Left and right pair of steps 45, on which the rider sitting on the seat 12 puts his/her feet, are provided on the rear portion of the lower portion of each of center frames 15. Shift pedal system 46 for the rider to perform the shift operation is provided in front of the step 45 on the left side. In addition, a side stand 47 is fixed to the lower portion of the center frame 15 on the left side.

Figure 3:
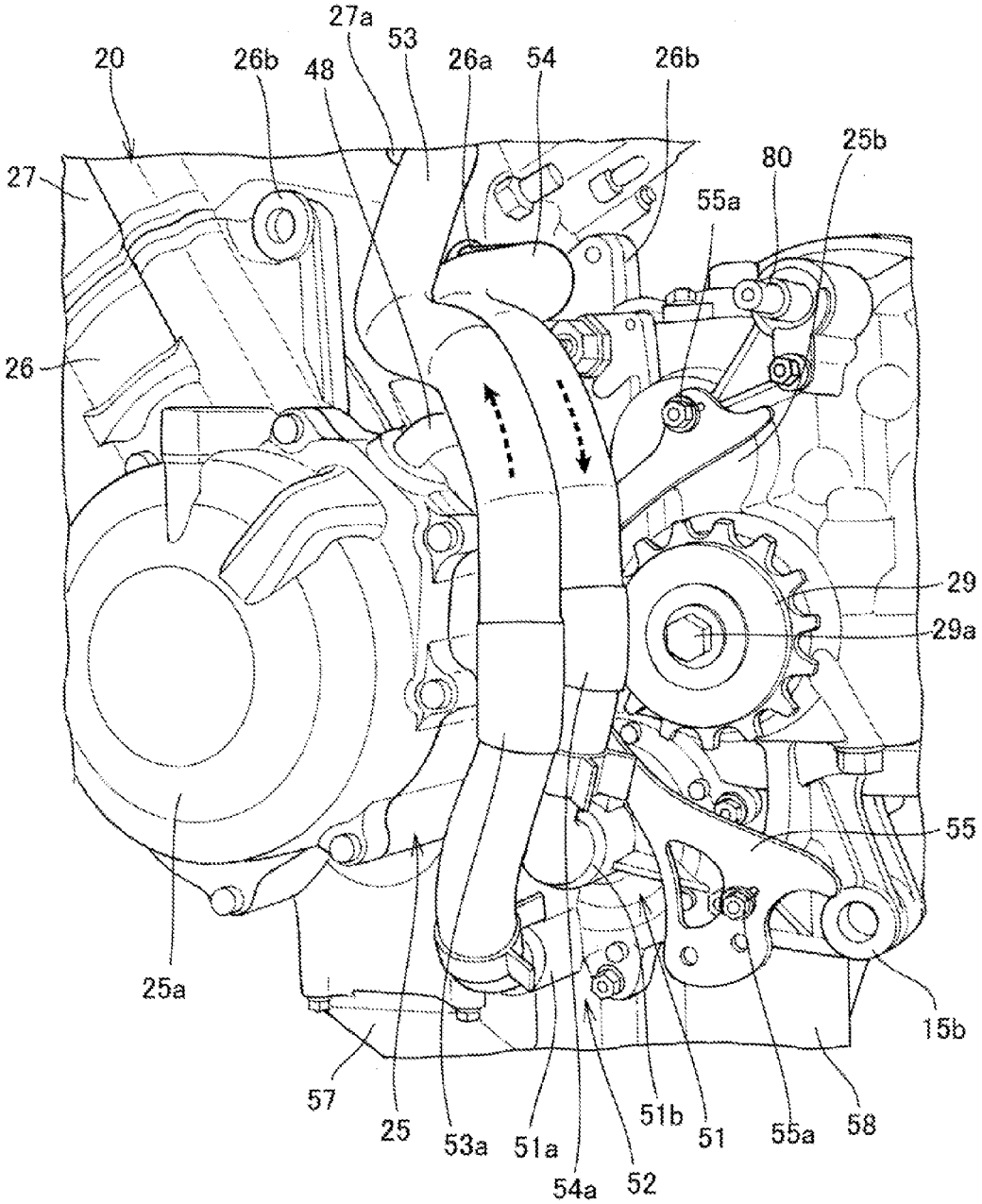
FIG. 3 is a perspective view showing the configuration in the periphery of a drive sprocket.

FIG. 3 is a perspective view showing the configuration in the periphery of the drive sprocket 29. In FIG. 3, the drawings of the body frame F, the side surface cover 50, the chain 31 and the like are omitted.

As shown in FIGS. 2 and 3, a generator storing portion 25*a*, which is swelled in a cylinder shape further outside in the width direction of the vehicle than the cylinder 26, is formed on the left side surface of the front portion of the crankcase 25. A generator (not shown), which is fixed to one end of the crankshaft 20*a*, is provided in the generator storing portion 25*a*. A wiring 48 of the above-mentioned generator is drawn out on the upper portion of the rear surface in a curved surface shape of the generator storing portion 25*a*. The wiring 48 bends to the inside in the width direction of the vehicle and extends to the rear surface side of the cylinder head 27.

The output shaft 20*b* is provided on a side surface of rear portion 25*b* on the left side of the crankcase 25 which is disposed in the rear of the generator storing portion 25*a*. The output shaft 20*b* is disposed in the rear of the crankshaft 20*a* substantially at the same height of that of the crankshaft 20*a*.

A pump portion 51, which circulates the cooling water of the engine 20, is provided on the side surface of rear portion 25*b* at the position between the crankshaft 20*a* and the output shaft 20*b* as well as below the output shaft 20*b*. The pump portion 51 has a pump shaft, which is driven by the power of crankshaft 20*a*, and a rotor (not shown), which is provided on the pump shaft, inside the crankcase 25.

The pump portion 51 includes a discharge pipe portion 51*a*, which discharges the cooling water, and an intake pipe portion 51*b* which sucks the cooling water into the pump portion 51. The discharge pipe portion 51*a* is positioned below as well as in front of the intake pipe portion 51*b*. In a side view, the discharge pipe portion 51*a* and the intake pipe portion 51*b* are arranged so as to overlap in the front-and-rear direction.

A cooling device 52 of the engine 20 includes the radiator 33, the pump portion 51, water jackets (not shown), which is formed in the wall of the engine 20, a discharge side hose 53 and an intake side hose 54 which connect the water jackets and the pump portion 51. The above-mentioned water jackets are independently formed respectively for the cylinder 26 and the cylinder head 27. On the rear surface of the cylinder head 27 as well as on the central portion in the width direction of the vehicle, there is formed a head-side hose joining portion 27*a* which communicates to the water jacket of the cylinder head 27. In addition, on the rear surface of the cylinder 26 as well as on the central portion in the width direction of the vehicle, there is formed a cylinder-side hose joining portion 26*a* which communicates to the water jacket of the cylinder 26.

The intake side hose 54, one end of which is joined to the intake pipe portion 51*b*, extends upward so as to be in parallel with the rear wall in the curved surface shape of the generator storing portion 25*a*, extends to the cylinder 26 side after bending inside in the width direction of the vehicle, and is joined to the cylinder-side hose joining portion 26*a*.

The discharge side hose 53, one side of which is joined to the discharge pipe portion 51*a*, extends upward so as to be in parallel with the rear wall in the curved surface shape of the generator storing portion 25*a* and the outer side surface of the intake side hose 54, extends to the cylinder head 27 side after bending inside in the width direction of the vehicle, and is joined to the head-side hose joining portion 27*a*.

The intake side hose 54 and the discharge side hose 53 are hoses with flexibility and heat-resisting property, for example rubber hoses.

More specifically, the intake side hose 54 and the discharge side hose 53 are arranged side by side in the width direction of the vehicle. In a side view of FIG. 2, the discharge side hose 53 is disposed so as to overlap the outer side surface of the intake side hose 54. Therefore, in a side view, hoses seem simple as if they were one, which reduces the space in the front and in the rear of the discharge side hose 53 and the intake side hose 54. Accordingly, the discharge side hose 53 and the intake side hose 54 can be arranged compact in the front-and-rear direction.

Protective tubes 53*a*, 54*a* (FIG. 3), which cover the outer peripheral surface of the hoses 53, 54 are attached to the part covered with the side surface cover 50 in the discharge side hose 53 and the intake side hose 54.

The cooling water, which is discharged from the pump portion 51 passes through the discharge side hose 53 as shown by an arrow in FIG. 3, reaches the water jacket of the cylinder head 27, flows from the water jacket via one hose (not shown) into the radiator 33 (FIG. 1). The cooling water, which is dissipated by the radiator 33, passes through the other hose (not shown), reaches the water jacket of the cylinder 26, then, as shown by the arrow in FIG. 3, passes through the intake side hose 54, is sucked into the pump portion 51, and is discharged to the discharge pipe portion 51*a* side again.

On the rear surface of the cylinder 26 as well as in front of the discharge side hose 53, there are provided a pair of hanger fixing portions 26*b* which the engine hanger 28 is fastened to.

Above the rear portion of the crankcase 25 as well as behind the discharge side hose 53 and the intake side hose 54, there is provided a brake unit storing portion 56. And an ABS (anti-lock braking system) unit (not shown), which controls the liquid pressure of the brake device of the motorcycle 1, is stored in the brake unit storing portion 56.

The drive sprocket 29 is spline-fitted in the shaft end of the output shaft 20*b*, and is fixed by a bolt 29*a*. On the side surface of rear portion 25*b* of the crankcase 25, there is provided a substantially C-shaped metal plate 55 which surrounds the drive sprocket 29 from the upper direction, from the forward direction and from the lower direction. The plate 55 is fixed by bolts 55*a* which penetrate the upper end and the lower end thereof. The plate 55 and the chain 31 are provided at such a position as to overlap with each other in the width direction of the vehicle, and the chain 31 passes the inner circumference side of the plate 55.

The discharge side hose 53 and the intake side hose 54 pass in front of the output shaft 20*b* as well as on the outer side of the drive sprocket 29 and the plate 55.

Figure 4:
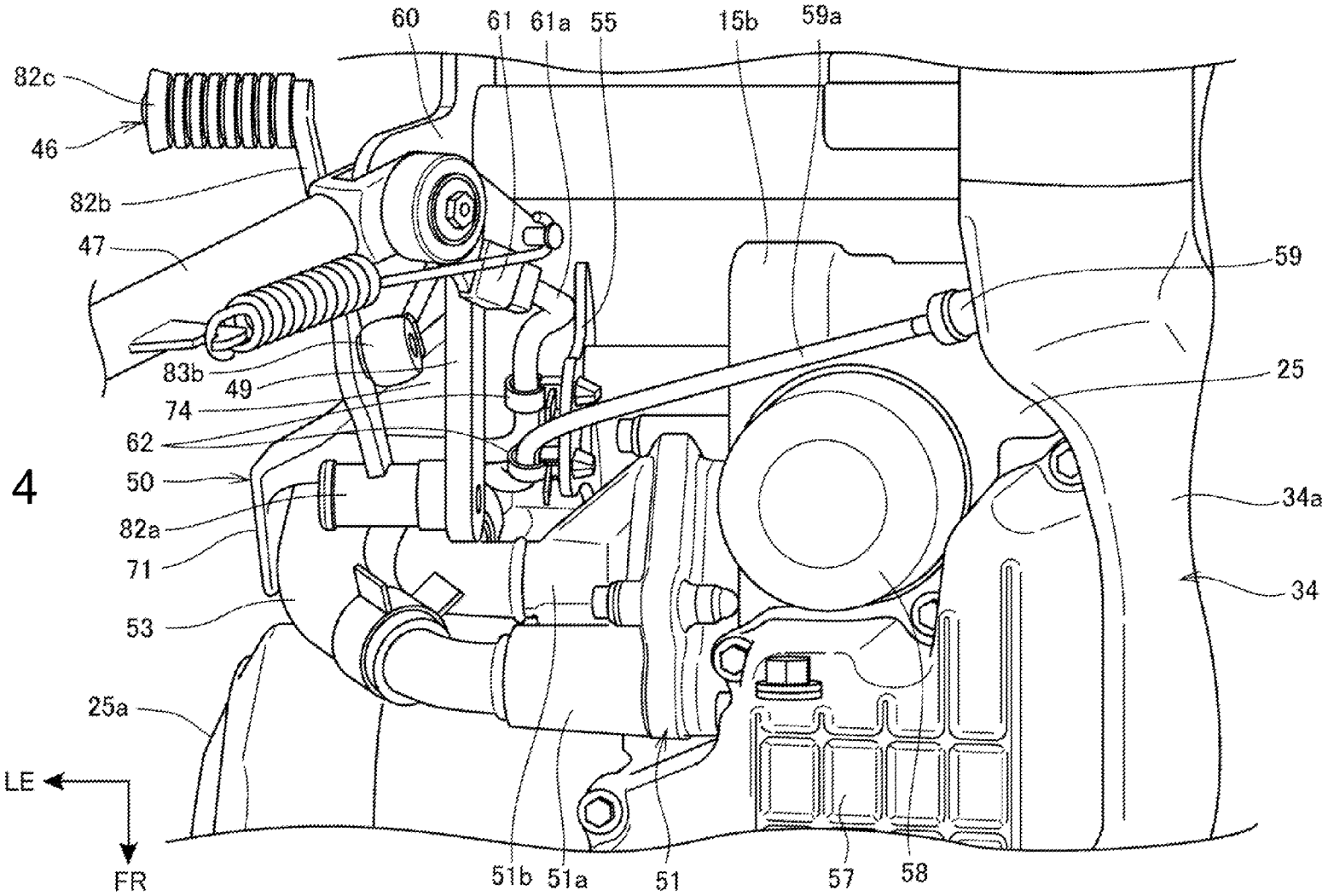
FIG. 4 is a view of the periphery of a pump portion shown from the bottom.

FIG. 4 is a view of the periphery of the pump portion 51 shown from the bottom.

An oil pan 57 for reserving engine oil is provided on the lower portion of the crankcase 25 so as to be swelled downward.

An oil filter 58 is provided behind the oil pan 57. A manifold portion 34*a*, which is configured by collecting four exhaust pipes 34 to one, is disposed on the side of the oil pan 57. A sensor 59 for detecting oxygen concentration in the manifold portion 34*a* is attached to the manifold portion 34*a*. And an electric wire 59*a* of the sensor 59 is drawn out to the left side, passes behind the oil pan 57, and extends to the side surface cover 50 side.

The side stand 47 is fixed to a stand stay 60 which extends downward from the center frame 15 on the left side. The side stand 47 has a stand sensor 61 for detecting which state the side stand 47 is in, in standing state or in accommodated state. An electric wire 61*a*, which is drawn out from the stand sensor 61, extends upward to the side surface cover 50 side.

The electric wires 59*a*, 61*a* are fixed via fixing bands 62 to the lower portion of the plate 55 which is exposed below the side surface cover 50, and then extend upward from here into the side surface cover 50.

On the lower portion of the center frame 15 on the left side, there is provided a bar-like pedal attaching portion 49 which extend forward from the vicinity of the attaching portion of the side stand 47.

Figure 5:
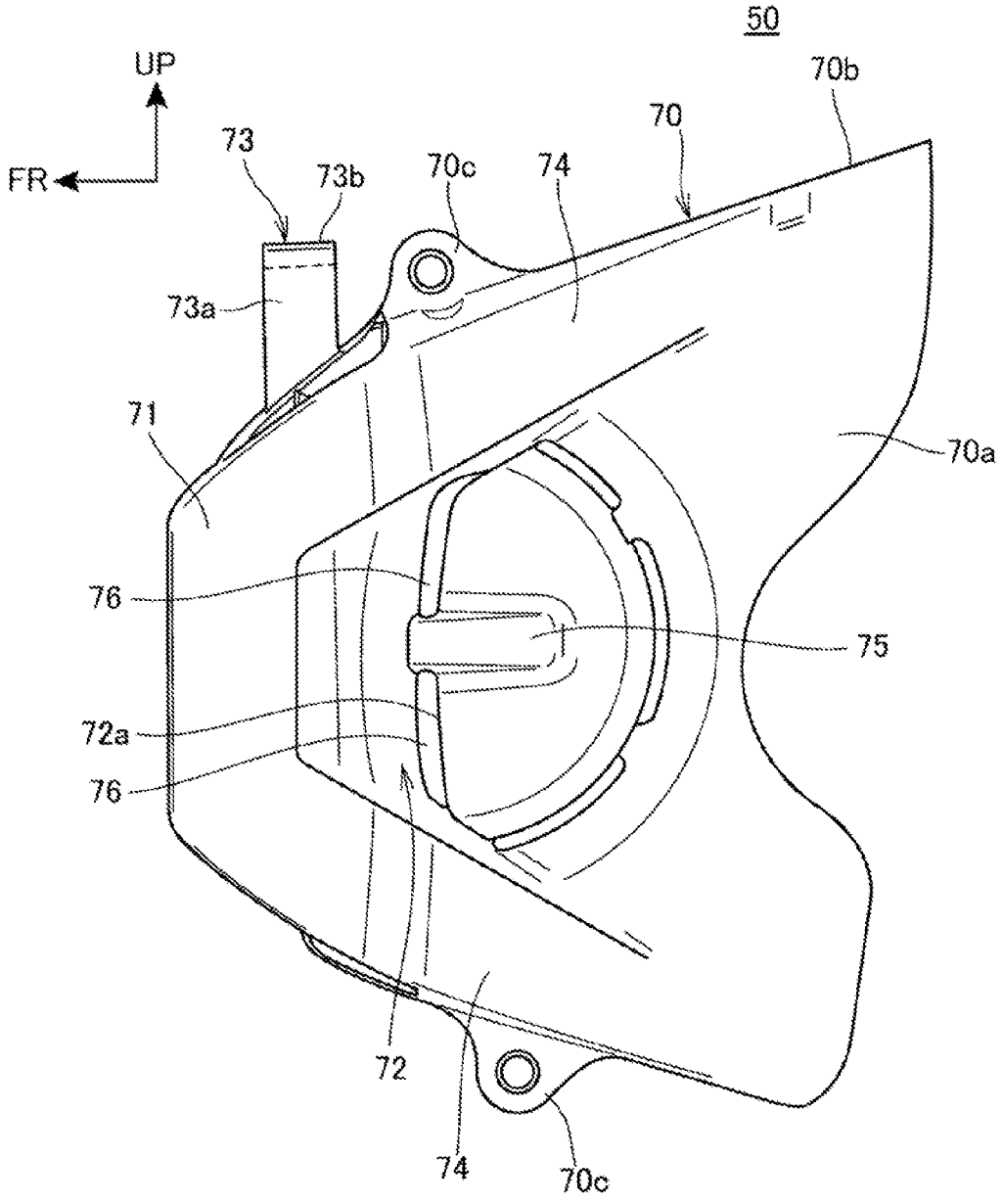
FIG. 5 is a left side elevation view of the side surface cover.
Figure 6:
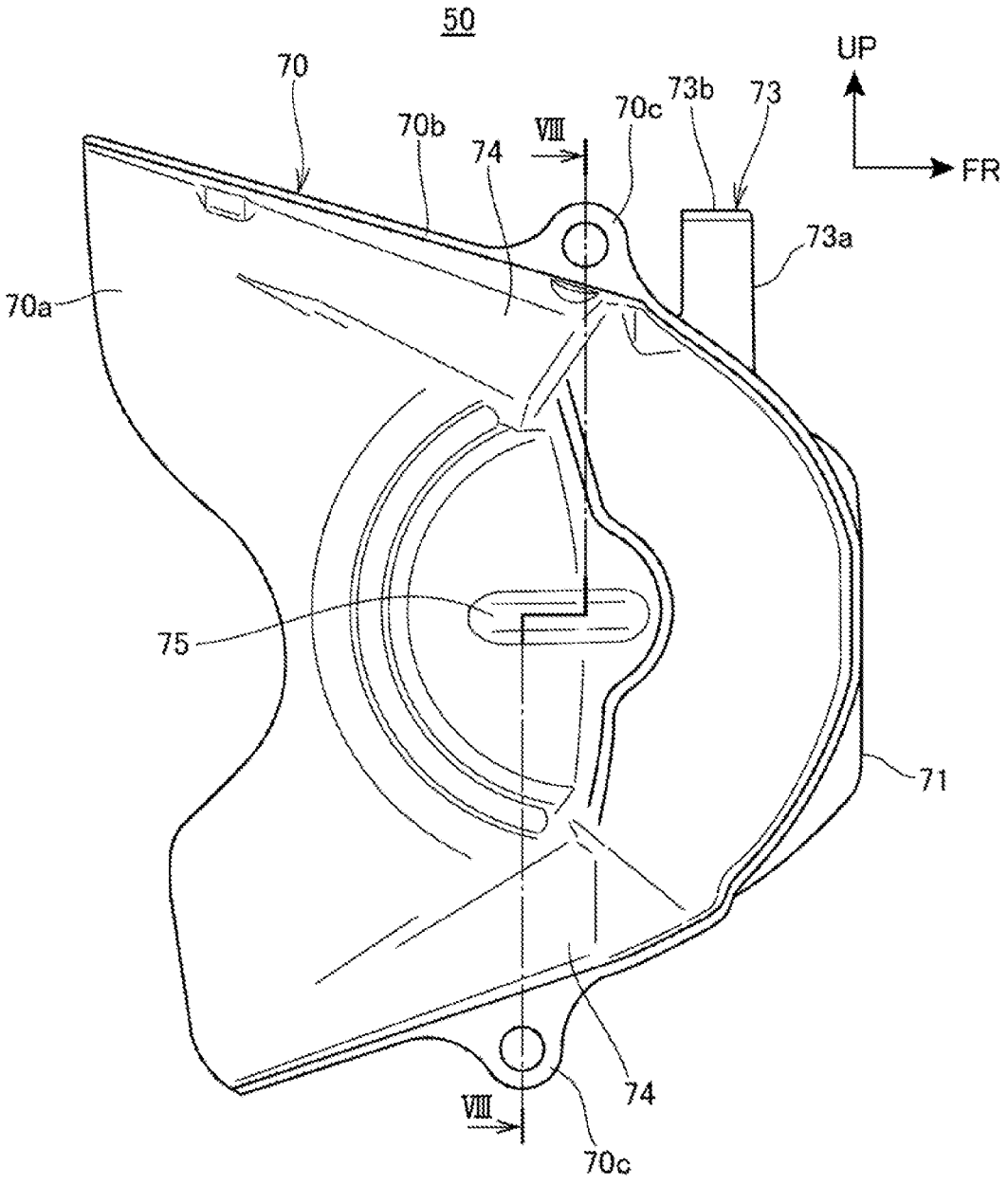
FIG. 6 is an elevation view of the side surface cover shown from the inside.
Figure 7:
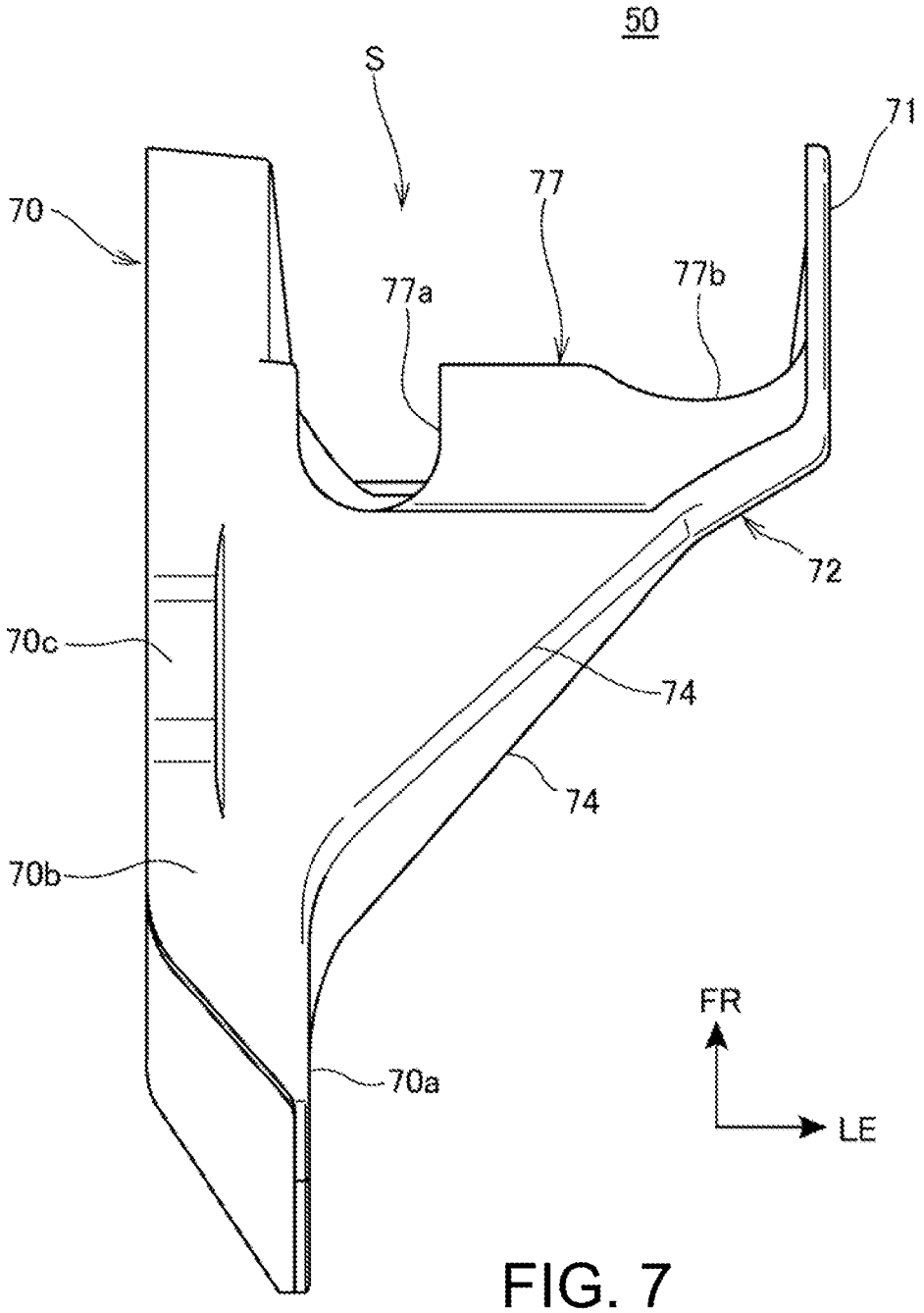
FIG. 7 is a bottom view of the side surface cover.
Figure 8:
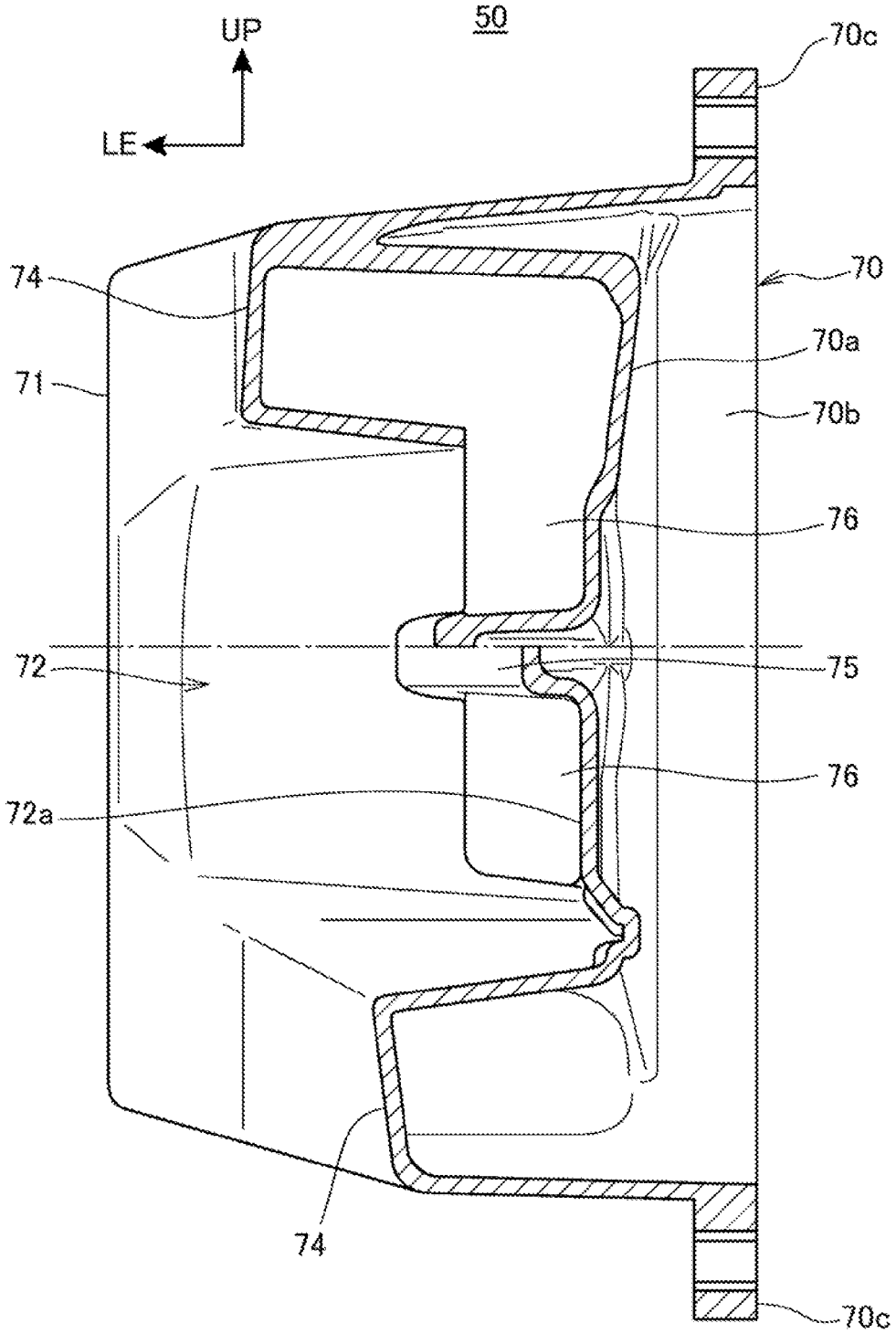
FIG. 8 is a cross-sectional view taken along line VIII-VIII of FIG. 6.
Figure 9:
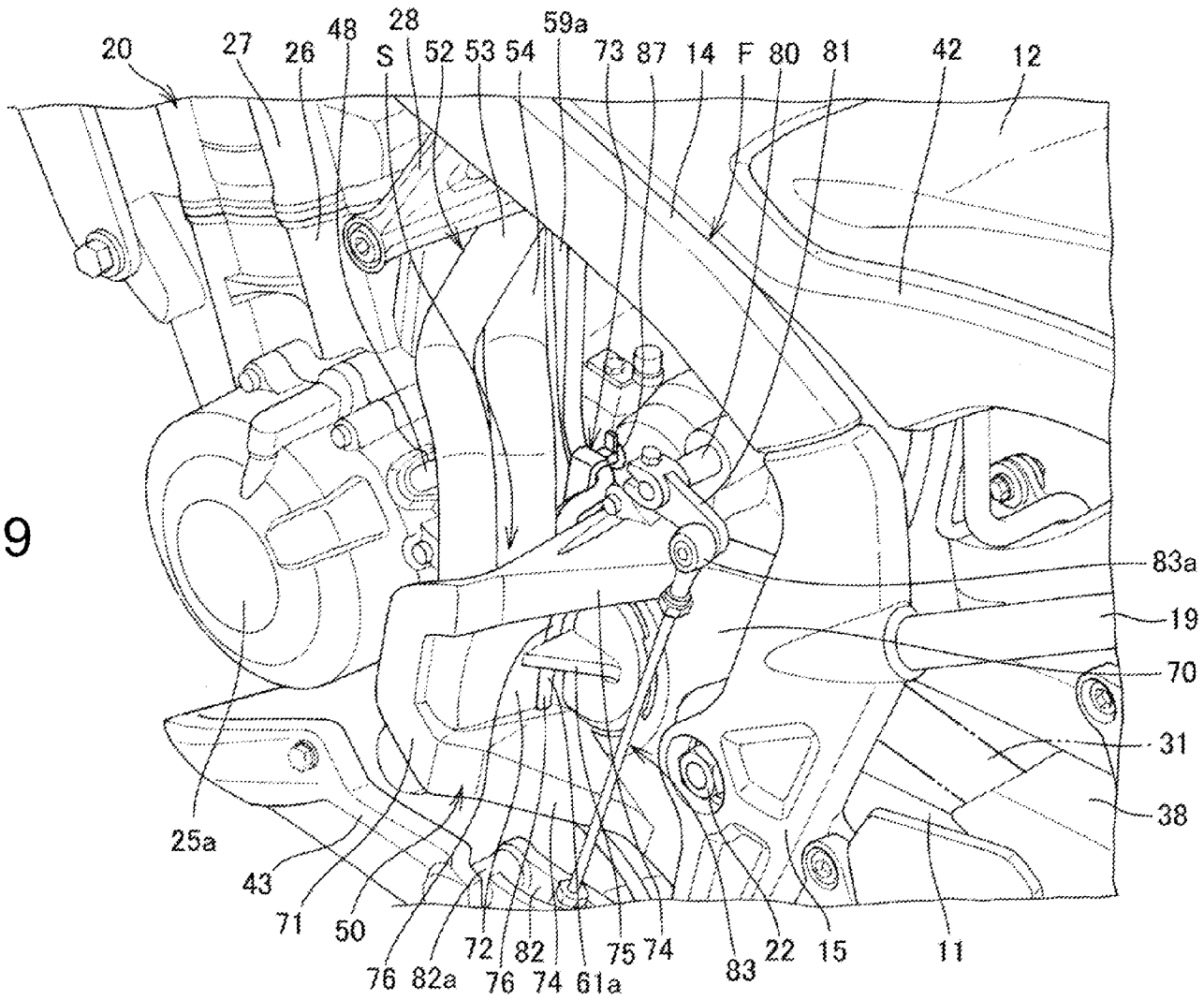
FIG. 9 is a perspective view of the periphery of the side surface cover shown from the rear and lateral side.

FIG. 5 is a left side view of the side surface cover 50. FIG. 6 is a side view of the side surface cover 50 shown from the inside. FIG. 7 is a bottom view of the side surface cover 50. FIG. 8 is a cross-sectional view taken along line VIII-VIII of FIG. 6. FIG. 9 is a perspective view of the periphery of the side surface cover 50 shown from the rear and lateral side.

Referring to FIGS. 2, and 5 to 9, the side surface cover 50 includes a sprocket cover portion 70, which covers the drive sprocket 29 from the outer side, the pipe cover portion 71, which covers the discharge side hose 53 from the outer side, and a joining wall portion 72 which integrally connects the sprocket cover portion 70 and the pipe cover portion 71. The side surface cover 50 is a resin-made cover which is configured by integrally molding the sprocket cover portion 70, the pipe cover portion 71 and the joining wall portion 72.

The sprocket cover portion 70 is a plate-like member, which covers from the vicinity of the front surface of the center frame 15 up to the vicinity of the rear surface of the generator storing portion 25*a* in a side view, becomes vertically longer toward the rear portion thereof, and becomes tapered and vertically shorter toward the front end side.

The sprocket cover portion 70 has a plate portion 70*a*, which faces the side surface of the drive sprocket 29, and a side wall portion 70*b* (FIG. 6) which is vertically provided inside in the width direction of the vehicle from the edge portion of the plate portion 70*a* excluding the rear edge portion, through which the chain 31 passes.

Stay portions 70*c*, 70*c*, which protrude upward and downward, are formed in a pair on the upper and lower surfaces of the side wall portion 70*b* in the intermediate portion in the front-and-rear direction of the sprocket cover portion 70. The side surface cover 50 is fixed together with the plate 55 to the side surface of rear portion 25*b* by each of the bolts 55*a* (FIG. 2) which are inserted in the stay portions 70*c*, 70*c*.

An electric wire holding portion 73, which protrudes upward, is formed on the upper surface of the front portion of the side wall portion 70*b* as well as in front of the stay portion 70*c*. The electric wire holding portion 73 has an extending portion 73*a*, which extends upward, and a claw portion 73*b* which extends from the upper end of the extending portion 73*a* to the inside in the width direction of the vehicle.

The pipe cover portion 71 is a plate-like member, which is provided so as to sandwich the discharge side hose 53 and the intake side hose 54 therebetween and the sprocket cover portion 70, is positioned further outside in the width direction of the vehicle than the sprocket cover portion 70 and covers a part of the discharge side hose 53 from the outer side. The pipe cover portion 71 is formed in substantially the same shape as the front portion of the sprocket cover portion 70 in a side view.

The space, which is surrounded by the pipe cover portion 71, the sprocket cover portion 70 and the joining wall portion 72 behind the rear wall of the generator storing portion 25*a*, is a wiring space S for kinds of hoses through which the discharge side hose 53, the intake side hose 54 and the electric wires 59*a*, 61*a* vertically pass.

The joining wall portion 72 is vertically provided towards the pipe cover portion 71 side so as to be in parallel with the outer side surface of the front portion of the sprocket cover portion 70 to the rear surfaces of the intake side hose 54 and the discharge side hose 53 and joined to the rear edge of the pipe cover portion 71. The joining wall portion 72 is formed, in a side view, at the position closer to the discharge side hose 53, which is further forward than the center of the output shaft 20*b* (FIG. 2). A joining position 72*a* between the joining wall portion 72 and the sprocket cover portion 70 is also positioned closer to the discharge side hose 53 than the output shaft 20*b*.

Reinforcing swelling wall portions 74, 74, which extend in parallel with the upper edge and the lower edge of the sprocket cover portion 70 and join the joining wall portion 72 and the sprocket cover portion 70, are joined respectively on the upper end and the lower end of the joining wall portion 72. The reinforcing swelling wall portions 74, 74 are vertically provided from the outer side surface of the rear portion of the sprocket cover portion 70 to the outside in the width direction of the vehicle, and are formed so as to gradually bulged and to become higher as they approach forward to the pipe cover portion 71 side in the front-and-rear direction.

An intermediate reinforcing wall portion 75, which joins the joining wall portion 72 and the sprocket cover portion 70, is formed between the upper and lower reinforcing swelling wall portions 74, 74 as well as on the intermediate portions in the vertical direction of the joining wall portion 72. The intermediate reinforcing wall portion 75 is vertically provided from the outer side surface of the front portion of the sprocket cover portion 70 to the outside in the width direction of the vehicle, and are formed so as to gradually bulged and to become higher as it approaches forward to the pipe cover portion 71 side in the front-and-rear direction.

Slits 76, 76, which penetrate the joining wall portion 72 and communicate with the intake side hose 54 side, are formed in a pair in the vicinity of the joining position 72*a* in the base end portion of the joining wall portion 72. By providing the slits 76, 76, the state of the wiring space S for kinds of hoses can be confirmed via the slits 76, 76 when attaching the side surface cover 50 and the like, and the heat in the wiring space S for kinds of hoses can be efficiently discharged through the slits 76, 76.

The slits 76, 76 extend vertically so as to stretch between the intermediate reinforcing wall portion 75 and the upper and lower reinforcing swelling wall portions 74, 74. That is, the intermediate reinforcing wall portion 75 is provided between the upper and lower slits 76, 76. Accordingly, even in the configuration provided with the slits 76, 76, the rigidity of the side surface cover 50 can be secured.

As shown in FIG. 7, a plate-like lower wall portion 77, which extends forward from the reinforcing swelling wall portion 74 side on the lower side into the wiring space S for kinds of hoses, is formed on the lower portion of the wiring space S for kinds of hoses. The lower wall portion 77 extends to the intermediate portion of the wiring space S for kinds of hoses in the front-and-rear direction. A cutout portion 77*a*, through which the electric wires 59*a*, 61*a* pass, is formed on the front edge on the sprocket cover portion 70 side in the lower wall portion 77. In addition, a hose guide portion 77*b*, which is recessed rearward in an arc-shape, is formed on the front edge on the pipe cover portion 71 side in the lower wall portion 77.

Figure 10:
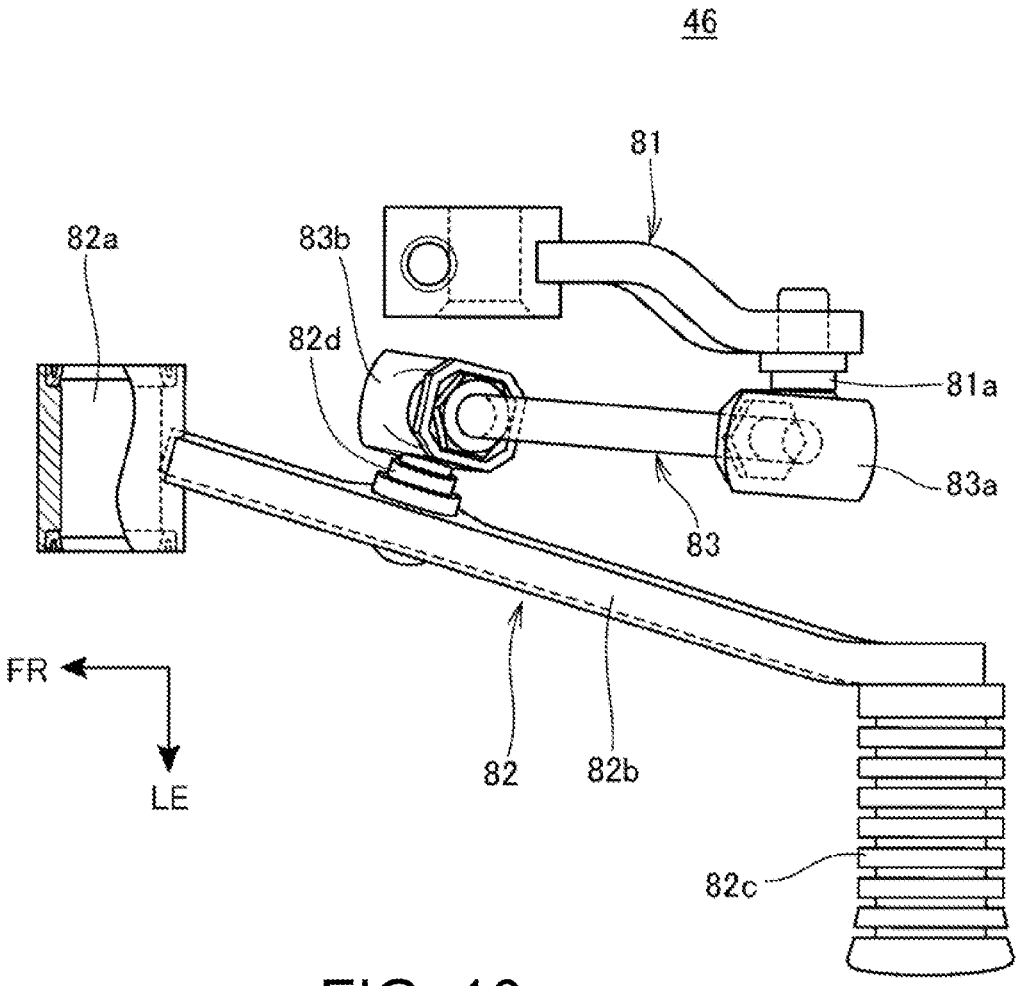
FIG. 10 is a plan view of a shift pedal system in a single body.

FIG. 10 is a top view of the shift pedal system 46 in a single body.

As shown in FIGS. 2, 9 and 10, the shift pedal system 46 includes an arm 81, which is fixed to a shift spindle 80 as a change shaft protruding outward from the crankcase 25, a shift pedal 82, which is operated by a rider, and a shift rod 83 which connects the shift pedal 82 with the arm 81.

The shift spindle 80 protrudes outward in the width direction of the vehicle from the upper of the side surface cover 50 at the upper portion of the side surface of rear portion 25*b* of the crankcase 25. When a shift drum (not shown) in the crankcase 25 is rotated in an interlocking manner with the rotation of the shift spindle 80, gear trains of the transmission are operated by the sliding operation of a shift fork (not shown) moving along the groove of the shift drum, which thereby performs shift.

The arm 81 extends rearward from the outer end portion of the shift spindle 80, and an arm connecting portion 81*a*, which protrudes outward, is provided on the rear end of the arm 81.

The shift pedal 82 includes a rotating portion 82*a*, which is rotatably attached to the pedal attaching portion 49 (FIG. 4) via a shaft (not shown) extending in the width direction of the vehicle, a lever portion 82*b*, which extends rearward from the rotating portion 82*a*, and an operating portion 82*c* which protrudes to the outer side from the rear end of the lever portion 82*b*. The lever portion 82*b* is provided so as to be positioned outside in the width direction of the vehicle as it approaches the rear side, and extends up to the side of the lower portion of the center frame 15. A pedal connecting portion 82*d*, which protrudes inside in the width direction of the vehicle, is provided on the front portion of the lever portion 82*b*. The shift pedal 82 is positioned below the side surface cover 50 as well as further outside in the width direction of the vehicle than the arm 81.

The shift rod 83, which is a bar-like member extending in a straight, has a join portion 83*a*, which is connected to the arm connecting portion 81*a*, on the upper end of the shaft rod and a join portion 83*b*, which is connected to the pedal connecting portion 82*d*, on the lower end of the shaft rod. The join portions 83*a*, 83*b*, which are ball join type, are rotatable three-dimensionally respectively with respect to the arm connecting portion 81*a* and the pedal connecting portion 82*d*.

The shift rod 83 extends vertically so as to be parallel with the plate portion 70*a* of the sprocket cover portion 70 and to straddle over the side surface cover 50 behind the reinforcing swelling wall portions 74, 74, and connects the shift pedal 82 to the arm 81. Since the arm connecting portion 81*a* is positioned further rearward than the pedal connecting portion 82*d*, the shift rod 83 is disposed so as to be slightly inclined rearward rather than vertically.

That is, the motorcycle 1 includes the shift spindle 80, which is provided on the rear and upper portion of the engine 20 for inputting the shift operation of the engine 20, the shift pedal 82, which is provided on the vehicle body for a rider to perform the shift operation, and the shift rod 83 which joins the shift spindle 80 and the shift pedal 82.

When the rider operates the operating portion 82*c* with his/her toe, the shift pedal 82 rotates with the rotating portion 82*a* as an axis, the motion of the shift pedal 82 is transmitted to the arm 81 via the shift rod 83 and the shift spindle 80 is rotated via the arm 81.

The rotating portion 82*a* of the shift pedal 82 is covered from the outer side by the rear end portion of the undercover 43 as shown in FIG. 1. In FIG. 2, however, the drawing of the rear end portion is omitted.

Figure 11:
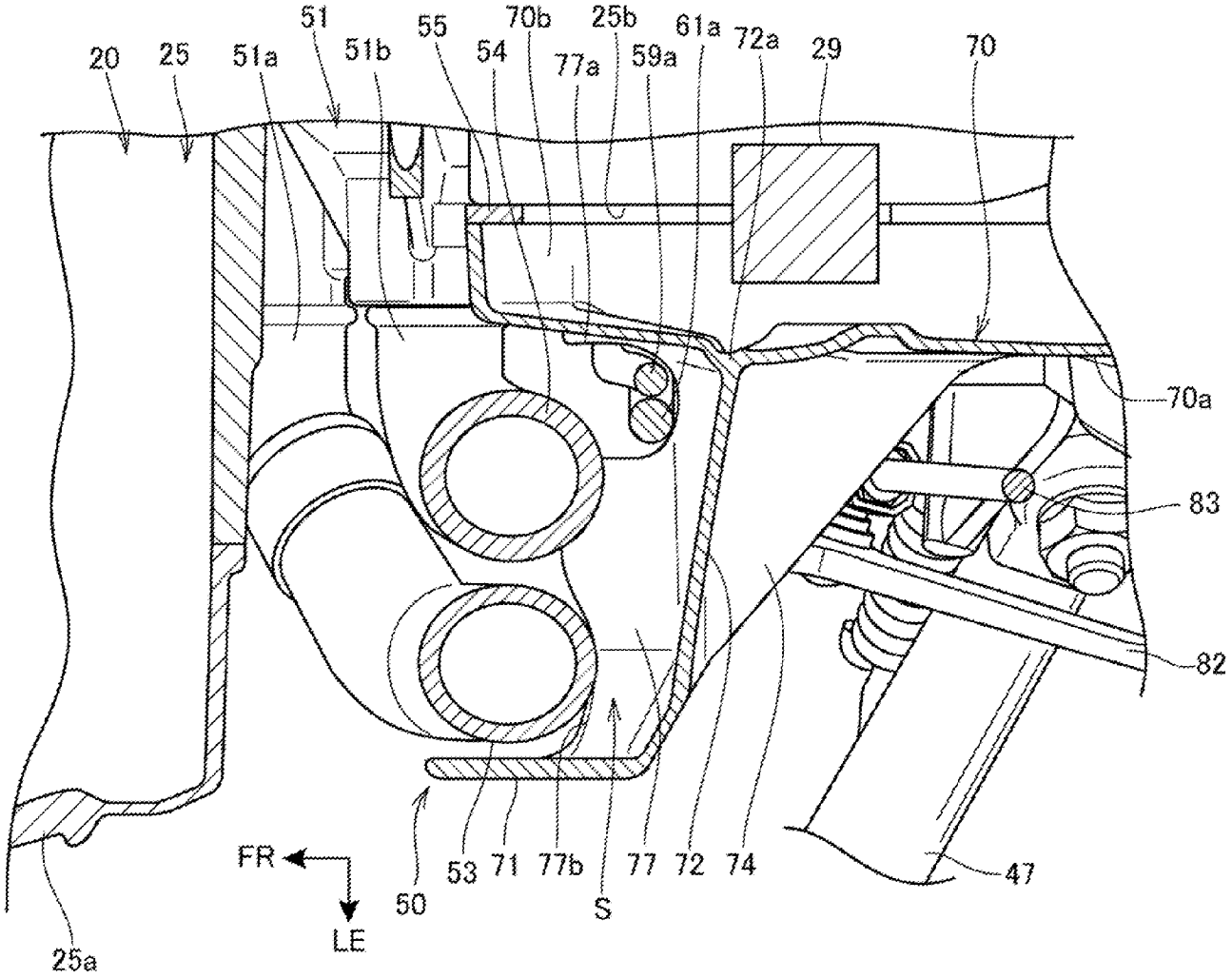
FIG. 11 is a cross-sectional view taken along line XI-XI of FIG. 2.

FIG. 11 is a cross-sectional view taken along line XI-XI of FIG. 2.

As shown in FIG. 11, in a sectional view of the lower portion of the side surface cover 50, the discharge side hose 53 and the intake side hose 54 pass into the wiring space S for kinds of hoses from below in such a state to be aligned side by side in the width direction of the vehicle so as to be in parallel with the front end of the lower wall portion 77. The discharge side hose 53 is positioned so as to be in parallel with the hose guide portion 77*b*. The electric wires 59*a*, 61*a* pass through the cutout portion 77*a* from below, and are wired to the wiring space S for kinds of hoses. In this way, by providing the lower wall portion 77, it is possible to position the discharge side hose 53, the intake side hose 54 and the electric wires 59*a*, 61*a* while the lower wall portion 77 suppresses the foreign substance from entering from below into the wiring space S for kinds of hoses.

Figure 12:
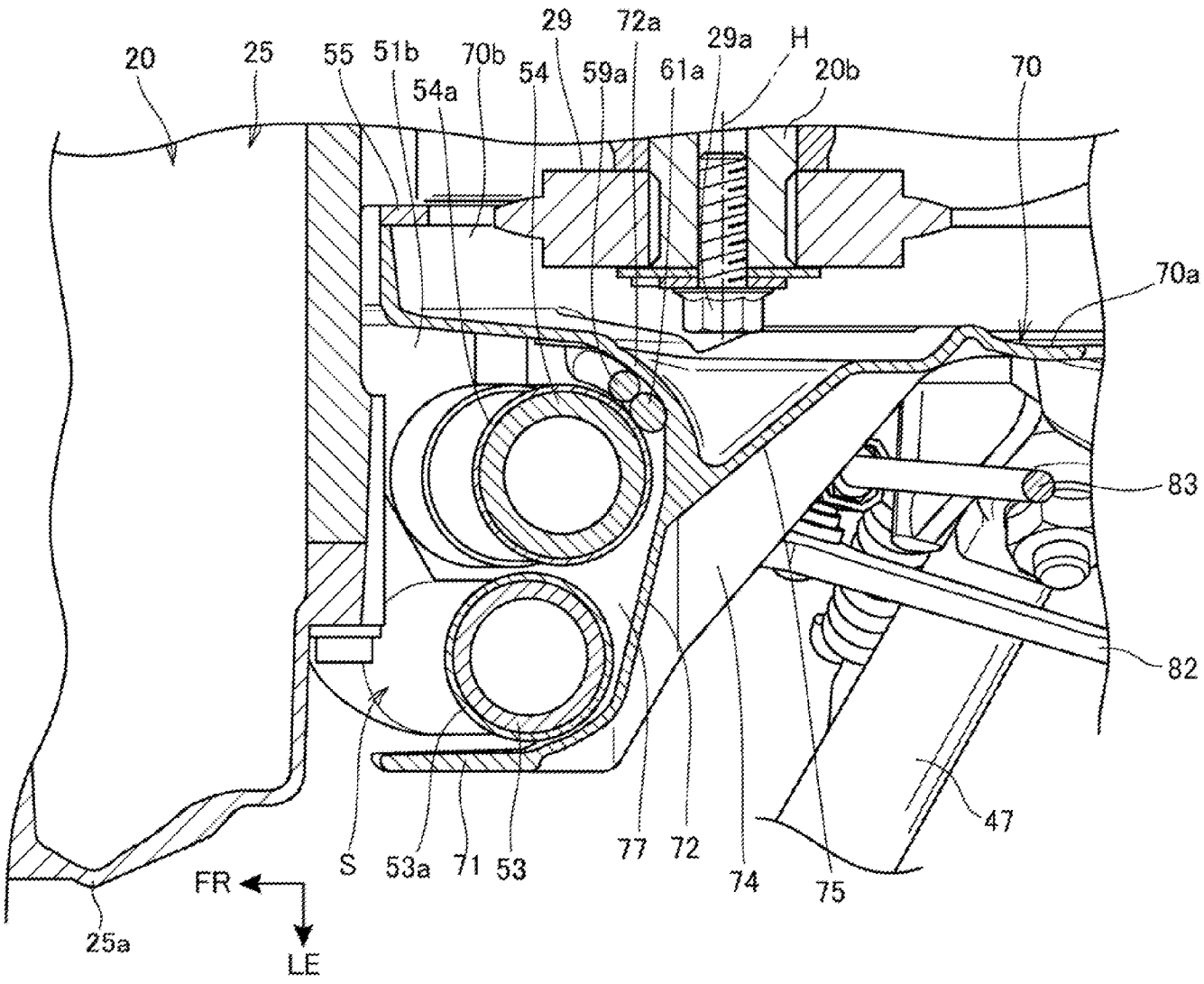
FIG. 12 is a cross-sectional view taken along line XII-XII of FIG. 2.

FIG. 12 is a cross-sectional view taken along line XII-XII of FIG. 2.

As shown in FIG. 12, in a sectional view of the intermediate portion in the vertical direction of the side surface cover 50, the protective tubes 53*a*, 54*a* are attached respectively to the discharge side hose 53 and the intake side hose 54. In addition, the pipe cover portion 71 is positioned further inside in the width direction of the vehicle than the outer side surface of the generator storing portion 25*a*.

The position of discharge side hose 53 in the wiring space S for kinds of hoses is restricted by abutting on the pipe cover portion 71 and the joining wall portion 72. In addition, the position of the intake side hose 54 in the wiring space S for kinds of hoses is restricted by abutting on the joining wall portion 72 and the plate portion 70*a*. In the embodiment of the present invention, since the protective tubes 53*a*, 54*a* are provided, it is possible to prevent the wall portion and the like, which partition the wiring space S for kinds of hoses, from strongly abutting on the discharge side hose 53 and the intake side hose 54. Accordingly, the discharge side hose 53 and the intake side hose 54 can be effectively positioned with the side surface cover 50.

Here, the intake side hose 54 and the discharge side hose 53 are not always required to abut on the wall portion for partitioning the wiring space S for kinds of hoses. The intake side hose 54 and the discharge side hose 53, which are flexible long hoses, might abut or not abut on the wall portion for partitioning the wiring space S for kinds of hoses depending on factors such as attaching state and dimension error. The wall portion for partitioning the wiring space S for kinds of hoses may be configured so as to abut on the intake side hose 54 and the discharge side hose 53, for example, when the intake side hose 54 and the discharge side hose 53 are deviated further than usual.

As shown in FIG. 12, the electric wires 59*a*, 61*a* are positioned so as to be sandwiched between the intake side hose 54 and the wall portion in the vicinity of the joining position 72*a* of the joining wall portion 72, and extend upward so as to be in parallel with the intake side hose 54. The diameter of each of the electric wires 59*a*, 61*a* is smaller than that of the intake side hose 54 and the diameter of each of the electric wires 59*a*, 61*a* in a bundle is smaller than that of the intake side hose 54. In this way, by wiring the electric wires 59*a*, 61*a* with the wiring space S for kinds of hoses for routing the intake side hose 54 and the discharge side hose 53, the electric wires 59*a*, 61*a* are disposed in a compact space. Especially, the vicinity of the joining position 72*a* is the corner portion in which the joining wall portion 72 and the plate portion 70*a* intersect, and is a dead space relative to the intake side hose 54 in substantially a circle cross-sectional shape. Accordingly, the electric wires 59*a*, 61*a* can be disposed by effectively using the space of the corner portion. In addition, the electric wires 59*a*, 61*a* are sandwiched by the joining wall portion 72 and the plate portion 70*a*, which is the high-rigid area since the intermediate reinforcing wall portion 75 is provided, and the intake side hose 54. Accordingly, the electric wires 59*a*, 61*a* can be effectively supported. In addition, since the electric wires 59*a*, 61*a* are disposed on the back side of the intake side hose 54, the electric wires 59*a*, 61*a* are hidden, which thereby can improve the external appearance.

In the embodiment of the present invention, the discharge side hose 53 and the intake side hose 54 are provided side by side, the joining wall portion 72 is provided so as to be in parallel with the rear surfaces of the discharge side hose 53 and the intake side hose 54, and the joining position 72*a* of the joining wall portion 72 is positioned further forward than a center axis H of the output shaft 20*b* at the same time. Accordingly, it is possible to reduce the space in the front and in the rear of the discharge side hose 53, the intake side hose 54, the pipe cover portion 71 and the joining wall portion 72, and to secure a large space behind the joining wall portion 72. In such a configuration, the rider can put his/her foot on the large space in front of the step 45.

The shift rod 83 of the shift pedal system 46 is disposed in the space behind the joining wall portion 72. The shift rod 83 is positioned further inside in the width direction of the vehicle than the pipe cover portion 71 and the outer side surface of the center frame 15 on the left side. Accordingly, even if the periphery of the side surface cover 50 is subject to the force from outside, it is possible to suppress the influence on the shift rod 83.

Figure 13:
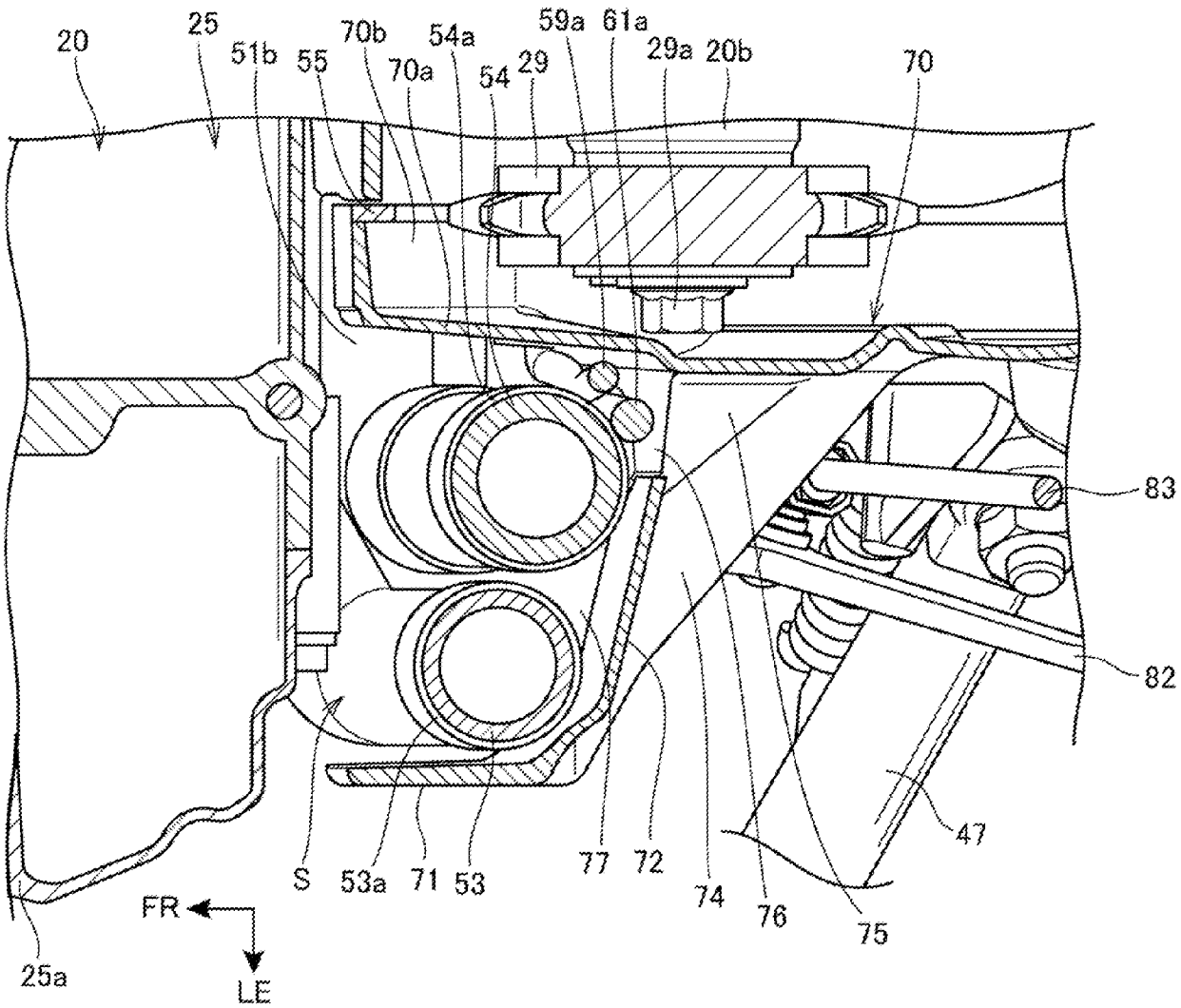
FIG. 13 is a cross-sectional view taken along line XIII-XIII of FIG. 2.

FIG. 13 is a cross-sectional view taken along line XIII-XIII of FIG. 2.

As shown in FIG. 13, in a sectional view of the upper portion of the side surface cover 50, the slit 76 is provided on the joining wall portion 72 on the rear side of the electric wires 59*a*, 61*a*. When attaching the side surface cover 50 and the like, the work can be done while confirming the state of the electric wires 59*a*, 61*a* and the intake side hose 54 through the slit 76, which achieves good workability. Accordingly, the electric wires 59*a*, 61*a* can be supported such that the electric wires 59*a*, 61*a* are properly sandwiched between the intake side hose 54 and the joining wall portion 72.

Figure 14:
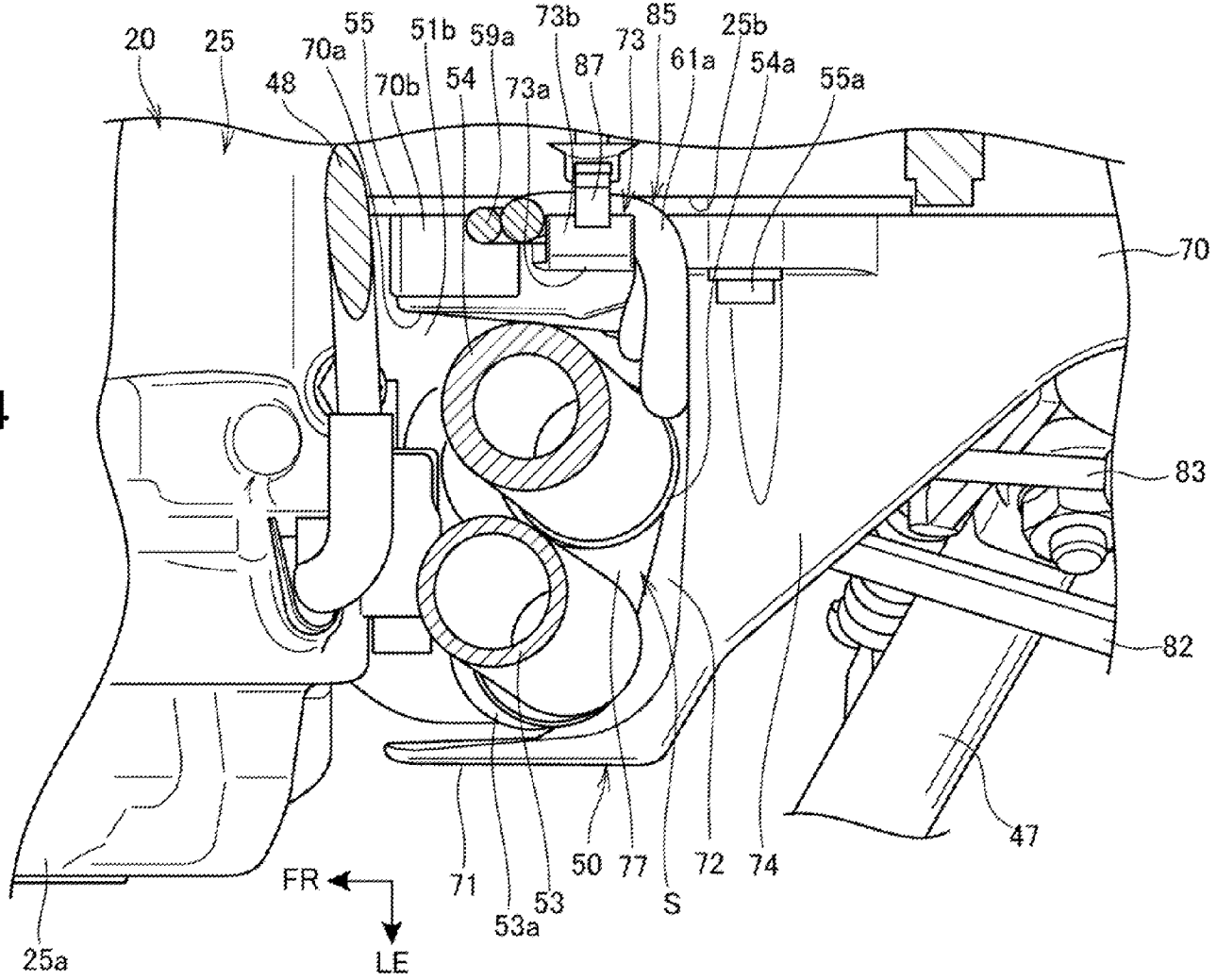
FIG. 14 is a cross-sectional view taken along line XIV-XIV of FIG. 2.

FIG. 14 is a cross-sectional view taken along line XIV-XIV of FIG. 2.

As shown in FIGS. 2, 9 and 14, the electric wire holding portion 73 is disposed on the upper surface of the side wall portion 70*b*, in front of the joining wall portion 72 as well as inside in the width direction of the vehicle of the intake side hose 54, and is hidden so as to overlap the discharge side hose 53 and the intake side hose 54 in a side view.

The electric wires 59*a*, 61*a* are drawn out upward from the wiring space S, bend inside in the width direction of the vehicle, bend forward at a bending portion 85 on the rear surface side of the electric wire holding portion 73 as well as are supported so as to be hooked on the electric wire holding portion 73, and then extend upward. More specifically, the upward motion of the electric wires 59*a*, 61*a* is restricted by the claw portion 73*b*, and the outward motion in the width direction of the vehicle of the electric wires 59*a*, 61*a* is restricted by the extending portion 73*a*. In addition, the electric wires 59*a*, 61*a* are fixed to the electric wire holding portion 73 by a band 87.

In such a configuration, the electric wire holding portion 73 is disposed on the back side of the discharge side hose 53 and the intake side hose 54 and is hidden in a side view, which thereby allows the neat appearance and can improve the external appearance.

As described above, according to the embodiment applying the present invention, a side surface cover 50 includes a joining portion 72 which is vertically arranged from the sprocket cover portion 70 covering the drive sprocket 29, which is provided on the output shaft 20*b* for transmitting the driving force to the rear wheel 3, towards the pipe cover portion 71 so as to be in parallel with the intake side hose 54 and the discharge side hose 53 arranged side by side in the width direction of the vehicle and integrally joins the sprocket cover portion 70 with the pipe cover portion 71. Thus, it is possible to shorten the length in the front-and-rear direction of the pipe cover portion 71, which is swollen in the width direction of the vehicle, and to reduce the size in the width direction of the vehicle of the engine 20 including the pipe cover portion 71. Further, the sprocket cover portion 70 and the pipe cover portion 71 are integrally joined with the joining wall portion 72, which can secure the rigidity. Accordingly, it is possible to effectively hold the intake side hose 54 and the discharge side hose 53 with the pipe cover portion 71 and the joining wall portion 72.

In addition, in the area in parallel with the intake side hose 54 and the discharge side hose 53 in the joining wall portion 72, the joining position 72*a* of the joining wall portion 72 with the sprocket cover portion 70 is provided so as to be closer to the intake side hose 54 and the discharge side hose 53 than the center axis H of the output shaft 20*b*, which thereby can reduce the space in the front and in the rear of the pipe the joining wall portion 72 and the pipe cover portion 71. Thus, it is possible to reduce the size in the width direction of the portion on the lateral side of the output shaft 20*b* in the engine 20.

In addition, the reinforcing swelling wall portions 74, 74, which are joined to the upper end portion and the lower end portion of the joining wall portion 72 and are gradually bulged from the sprocket cover portion 70 towards the pipe cover portion 71, are provided further forward than the shift rod 83 which passes by the side of the output shaft 20*b*. Thus, by reinforcing the upper end portion and the lower end portion of the joining wall portion 72 with the reinforcing swelling wall portions 74, 74, the rigidity of the entire side surface cover 50 can be effectively enhanced.

Further, the slits 76, 76, which penetrate on the side provided with the intake side hose 54 and the discharge side hose 53, are formed so as to be close to the joining position 72*a* with the sprocket cover portion 70 in the joining wall portion 72. Thus, since the side surface cover 50 can be attached while checking the position of the intake side hose 54 and the discharge side hose 53 through the slits 76, 76, the workability can be enhanced.

In addition, the slits 76, 76 are provided in plural in the upper and lower portion, and the intermediate reinforcing wall portion 75, which is gradually bulged from the sprocket cover portion 70 towards the joining wall portion 72, is formed between the slits 76, 76. Thus, even in the configuration provided with the slits 76, 76, the rigidity can be secured.

Moreover, electric wires 59*a*, 61*a* of the motorcycle 1 are arranged so as to be in parallel with the intake side hose 54 while being sandwiched between the intake side hose 54, the joining wall portion 72 and the plate portion 70*a*. Thus, the electric wires 59*a*, 61*a* are allowed to pass through the space in which the intake side hose 54 are disposed, and also the electric wires 59*a*, 61*a* can be effectively held by being sandwiched between the intake side hose 54, the joining wall portion 72 and the plate portion 70*a*.

Further, in a side view of the engine 20, the electric wires 59*a*, 61*a* are disposed so as to overlap the back side of the discharge side hose 53 and the intake side hose 54. Thus, the electric wires 59*a*, 61*a* can be hidden with the discharge side hose 53 and the intake side hose 54, which thereby can improve the external appearance.

In addition, an electric wire holding portion 73 for positioning the electric wires 59*a*, 61*a* is integrally formed with the sprocket cover portion 70, and the electric wire holding portion 73 is disposed so as to overlap the back side of the discharge side hose 53 and the intake side hose 54 in a side view. Thus, the electric wires 59*a*, 61*a* can be positioned with the integrally-formed electric wire holding portion 73, and the external appearance can be improved by hiding the electric wire holding portion 73 with the discharge side hose 53 and the intake side hose 54.

Incidentally, the above-mentioned embodiment shows an aspect applying the present invention, and the present invention is not limited to the above-described preferred embodiment.

In the embodiment of the present invention, the side surface cover 50 is explained as a cover covering the drive sprocket 29 which the chain 31 is wound around, but is not limited to this, may cover the drive sprocket which a belt for driving the rear wheel 3 is wound around.

In addition, although in the above-mentioned embodiment the electric wires 59*a*, 61*a* are explained to be disposed so as to be sandwiched between the intake side hose 54, the joining wall portion 72 and the plate portion 70*a*, the present invention is not limited to the above-described preferred embodiment. The electric wires 59*a*, 61*a* may be disposed so as to be sandwiched between the intake side hose 54 and the sprocket cover portion 70 and/or the joining wall portion 72.

DESCRIPTION OF REFERENCE NUMERALS

1 motorcycle
3 rear wheel (driving wheel)
20 engine (internal combustion engine)
20*b* output shaft (output portion)
29 drive sprocket (driving member)
50 side surface cover
52 cooling device
53 discharge side hose (cooling water pipe)
54 intake side hose (cooling water pipe)
59*a* electric wire
61*a* electric wire
70 sprocket cover portion (cover)
71 pipe cover portion
72 joining wall portion (joining portion)
72*a* joining position
73 electric wire holding portion
74, 74 reinforcing swelling wall portion (reinforcing swelling portion)
75 intermediate reinforcing wall portion (central reinforcing portion)
76, 76 slit (opening)
80 shift spindle (change shaft)
82 shift pedal
83 shift rod
H center axis

The invention claimed is:

1. A cover structure of an internal combustion engine of a motorcycle with a cooling device for cooling the engine, the cover structure comprising:

a one-piece side surface cover including:

a driving member cover portion, which is provided on said internal combustion engine so as to cover from a width direction of the vehicle a driving member provided on an output portion of the internal combustion engine for transmitting a driving force to a driving wheel;

a pipe cover portion, which is positioned further outside in the width direction of the vehicle than the driving member cover portion, the pipe cover portion and the driving member cover portion arranged to sandwich a plurality of cooling water pipes of said cooling device;

a joining portion, which is vertically arranged from said driving member cover portion towards said pipe cover portion so as to be in parallel with the plurality of said cooling water pipes arranged side by side in the width direction of the vehicle and integrally joins said driving member cover portion with said pipe cover portion; and a reinforcing portion separated from said cooling pipes by said joining portion, the reinforcing portion joining said joining portion with said driving member cover portion.

2. The cover structure according to claim 1, wherein in an area in parallel with the plurality of said cooling water pipes in said joining portion, a joining position of the joining portion with said driving member cover portion is provided so as to be closer to the plurality of said cooling water pipes than a center axis of said output portion.

3. A cover structure of an internal combustion engine of a motorcycle with a cooling device for cooling the engine, the cover structure comprising:

a side surface cover including:

a driving member cover portion, which is provided on said internal combustion engine so as to cover from a width direction of the vehicle a driving member provided on an output portion of the internal combustion engine for transmitting a driving force to a driving wheel;

a pipe cover portion, which is provided so as to cover from the width direction of the vehicle a plurality of cooling water pipes of said cooling device; and a joining portion, which is vertically arranged from said driving member cover portion towards said pipe cover portion so as to be in parallel with the plurality of said cooling water pipes arranged side by side in the width direction of the vehicle and integrally joins said driving member cover portion with said pipe cover portion, wherein said motorcycle includes a change shaft, which is provided on a rear portion and an upper portion of said internal combustion engine and inputs a shift operation of the internal combustion engine, a shift pedal, which is provided on the vehicle body for a rider to perform the shift operation, and a shift rod, which joins said change shaft and said shift pedal, and wherein reinforcing swelling portions, which are joined to an upper end portion and a lower end portion of said joining portion and are gradually bulged from said driving member cover portion towards said pipe cover portion, are provided further forward than said shift rod which passes by a side of said output portion of said internal combustion engine.

4. The cover structure according to claim 3, wherein openings, which penetrate on a side provided with the plurality of said cooling water pipes, are formed so as to be close to the joining position with said driving member cover portion in said joining portion.

5. The cover structure according to claim 4, wherein said openings are provided in plural in the upper and lower portion, and a central reinforcing portion, which is gradually bulged from said driving member cover portion towards said joining portion, is formed between the openings.

6. A cover structure of an internal combustion engine of a motorcycle with a cooling device for cooling the engine, the cover structure comprising:

a side surface cover including:

a driving member cover portion, which is provided on said internal combustion engine so as to cover from a width direction of the vehicle a driving member provided on an output portion of the internal combustion engine for transmitting a driving force to a driving wheel;

a pipe cover portion, which is provided so as to cover from the width direction of the vehicle a plurality of cooling water pipes of said cooling device; and a joining portion, which is vertically arranged from said driving member cover portion towards said pipe cover portion so as to be in parallel with the plurality of said cooling water pipes arranged side by side in the width direction of the vehicle and integrally joins said driving member cover portion with said pipe cover portion, wherein electric wires of said motorcycle are arranged so as to be in parallel with the plurality of said cooling water pipes while being sandwiched between the plurality of said cooling water pipes and said driving member cover portion and/or said joining portion, and wherein in a side view of said internal combustion engine, said electric wires are disposed so as to overlap a back side of the plurality of said cooling water pipes.

7. The cover structure according to claim 6, wherein an electric wire holding portion for positioning said electric wires is integrally formed with said driving member cover portion, and the electric wire holding portion is disposed so as to overlap the back side of the plurality of said cooling water pipes in a side view.

8. The cover structure according to claim 2, wherein electric wires of said motorcycle are arranged so as to be in parallel with the plurality of said cooling water pipes while being sandwiched between the plurality of said cooling water pipes and said driving member cover portion and/or said joining portion.

9. The cover structure according to claim 8, wherein in a side view of said internal combustion engine, said electric wires are disposed so as to overlap a back side of the plurality of said cooling water pipes.

10. The cover structure according to claim 9, wherein an electric wire holding portion for positioning said electric wires is integrally formed with said driving member cover portion, and the electric wire holding portion is disposed so as to overlap the back side of the plurality of said cooling water pipes in a side view.

11. The cover structure according to claim 3, wherein electric wires of said motorcycle are arranged so as to be in parallel with the plurality of said cooling water pipes while being sandwiched between the plurality of said cooling water pipes and said driving member cover portion and/or said joining portion.

12. The cover structure according to claim 11, wherein in a side view of said internal combustion engine, said electric wires are disposed so as to overlap a back side of the plurality of said cooling water pipes.

13. The cover structure according to claim 12, wherein an electric wire holding portion for positioning said electric wires is integrally formed with said driving member cover portion, and the electric wire holding portion is disposed so as to overlap the back side of the plurality of said cooling water pipes in a side view.

14. The cover structure according to claim 4, wherein electric wires of said motorcycle are arranged so as to be in parallel with the plurality of said cooling water pipes while being sandwiched between the plurality of said cooling water pipes and said driving member cover portion and/or said joining portion.

15. The cover structure according to claim 14, wherein in a side view of said internal combustion engine, said electric wires are disposed so as to overlap a back side of the plurality of said cooling water pipes.

16. The cover structure according to claim 15, wherein an electric wire holding portion for positioning said electric wires is integrally formed with said driving member cover portion, and the electric wire holding portion is disposed so as to overlap the back side of the plurality of said cooling water pipes in a side view.

17. The cover structure according to claim 5, wherein electric wires of said motorcycle are arranged so as to be in parallel with the plurality of said cooling water pipes while being sandwiched between the plurality of said cooling water pipes and said driving member cover portion and/or said joining portion.

18. The cover structure according to claim 17, wherein in a side view of said internal combustion engine, said electric wires are disposed so as to overlap a back side of the plurality of said cooling water pipes.

19. The cover structure according to claim 18, wherein an electric wire holding portion for positioning said electric wires is integrally formed with said driving member cover portion, and the electric wire holding portion is disposed so as to overlap the back side of the plurality of said cooling water pipes in a side view.

* * * * *